US011199023B2

(12) United States Patent
Sun et al.

(10) Patent No.: US 11,199,023 B2
(45) Date of Patent: Dec. 14, 2021

(54) CENTRAL LOCKING APPARATUS FOR FOLDING TENT

(71) Applicant: ZHEJIANG JIANSHENG LEISURE PRODUCTS CO., LTD, Zhejiang (CN)

(72) Inventors: Yuanru Sun, Zhejiang (CN); Chao Zeng, Zhejiang (CN); Jian He, Zhejiang (CN)

(73) Assignee: ZHEJIANG JIANSHENG LEISURE PRODUCTS CO., LTD, Zhejiang (CN)

( * ) Notice: Subject to any disclaimer, the term of this patent is extended or adjusted under 35 U.S.C. 154(b) by 128 days.

(21) Appl. No.: 16/642,015

(22) PCT Filed: May 8, 2019

(86) PCT No.: PCT/CN2019/085931
§ 371 (c)(1),
(2) Date: Feb. 25, 2020

(87) PCT Pub. No.: WO2020/215371
PCT Pub. Date: Oct. 29, 2020

(65) Prior Publication Data

US 2020/0240168 A1 Jul. 30, 2020

(30) Foreign Application Priority Data

Apr. 26, 2019 (CN) ..... 201920587861.2

(51) Int. Cl.
*E04H 15/50* (2006.01)
*E04H 15/32* (2006.01)
(Continued)

(52) U.S. Cl.
CPC ..... *E04H 15/50* (2013.01); *E04H 15/322* (2013.01); *E04H 15/28* (2013.01); *E04H 15/42* (2013.01); *E04H 15/46* (2013.01); *E05B 65/00* (2013.01)

(58) Field of Classification Search
CPC ..... E04H 15/48; E04H 15/50
See application file for complete search history.

(56) References Cited

U.S. PATENT DOCUMENTS 10,060,153 B2 * 8/2018 Song ..... E04H 15/50
10,246,898 B2 * 4/2019 Jin ..... E04H 15/46
(Continued)

FOREIGN PATENT DOCUMENTS

CN 104763215 7/2015
CN 107386779 11/2017
(Continued)

OTHER PUBLICATIONS

"International Search Report (Form PCT/ISA/210) of PCT/CN2019/085931," dated Feb. 3, 2020, pp. 1-4.

*Primary Examiner* — Noah Chandler Hawk
(74) *Attorney, Agent, or Firm* — JCIP Global Inc.

(57) ABSTRACT

A new central locking apparatus for a folding tent includes a top plate, a bottom plate assembly, and a center rod disposed between the top plate and the bottom plate assembly. The bottom plate assembly includes a bottom plate, a wrench assembly rotatably connected to the bottom plate, and a limit sleeve slidably connected in the bottom plate. The wrench assembly abuts on the limit sleeve, and the wrench assembly is capable of driving the limit sleeve to slide. A limiting component is disposed at a lower end of the center rod, the limiting component may be built into the bottom plate to fit the limit sleeve in a locking manner, and a first elastic element is disposed between the limit sleeve and the bottom plate through fitting.

18 Claims, 25 Drawing Sheets

(51) Int. Cl.

| | |
|---|---|
| *E04H 15/42* | (2006.01) |
| *E05B 65/00* | (2006.01) |
| *E04H 15/28* | (2006.01) |
| *E04H 15/46* | (2006.01) |

(56) References Cited

U.S. PATENT DOCUMENTS

| | | | | |
|---|---|---|---|---|
| 10,273,710 | B2 * | 4/2019 | Yang | E04H 15/50 |
| 2006/0289048 | A1 * | 12/2006 | Choi | E04H 15/48 135/135 |
| 2018/0209167 | A1 * | 7/2018 | Yang | E04H 15/48 |
| 2019/0368232 | A1 * | 12/2019 | Sun | E05B 65/00 |

FOREIGN PATENT DOCUMENTS

| | | |
|---|---|---|
| CN | 206616933 | 11/2017 |
| CN | 108518120 | 9/2018 |
| CN | 109356442 | 2/2019 |
| JP | 2017160784 | 9/2017 |
| WO | 2017028659 | 2/2017 |

* cited by examiner

CENTRAL LOCKING APPARATUS FOR FOLDING TENT

CROSS-REFERENCE TO RELATED APPLICATION

This application is a 371 of international application of PCT application serial no. PCT/CN2019/085931, filed on May 8, 2019, which claims the priority benefit of China application no. 201920587861.2, filed on Apr. 26, 2019. The entirety of each of the above mentioned patent applications is hereby incorporated by reference herein and made a part of this specification.

BACKGROUND

Technical Field

The present invention belongs to the field of outdoor product technologies, and specifically, to a central locking apparatus for a folding tent.

Description of Related Art

A folding tent is a popular outdoor product. A traditional folding tent usually includes a column, a central locking apparatus, an upper ejector rod, a lower ejector rod, an outer support rod, a side rod of an inner support rod, and a tent cloth. An existing central locking apparatus has a problem that an operation is inconvenient and a one-hand operation cannot be performed. To address this problem, an applicant proposes a new central locking apparatus for a folding tent, so that the central locking apparatus can be more conveniently operated.

SUMMARY

To make up for a disadvantage of the prior art, the present invention provides a technical solution of a central locking apparatus for a folding tent.

A new central locking apparatus for a folding tent includes a top plate, a bottom plate assembly, and a center rod disposed between the top plate and the bottom plate assembly. The bottom plate assembly includes a bottom plate, a wrench assembly rotatably connected to the bottom plate, and a limit sleeve slidably connected in the bottom plate, the wrench assembly abuts on the limit sleeve, the wrench assembly is capable of driving the limit sleeve to slide, a limiting component is disposed at a lower end of the center rod, the limiting component may be built into the bottom plate to fit the limit sleeve in a locking manner, and a first elastic element is fittingly disposed between the limit sleeve and the bottom plate.

Accordingly, the wrench assembly includes a wrench, the wrench includes a wrench operation portion and a wrench execution portion that are fixedly connected, the wrench operation portion is located on a groove on an outer side of a bottom portion of the bottom plate, and the wrench execution portion is located in the bottom plate and abuts on the limit sleeve.

Accordingly, the wrench assembly includes a wrench, a first lower sliding block, and a first upper sliding block, the wrench is located on a groove on an outer side of a bottom portion of the bottom plate, the first lower sliding block is connected to the bottom plate in a manner of sliding up and down, the first upper sliding block is located at an upper end of the first lower sliding block and abuts on the upper end, the first upper sliding block abuts on the limit sleeve, the first upper sliding block is connected to the bottom plate in a manner of sliding to left and right, and when the first lower sliding block slides upwards, the first lower sliding block is capable of pushing the first upper sliding block to slide towards the limit sleeve.

Accordingly, one end, of the wrench, abutting on the first lower sliding block is a cam structure.

Accordingly, a lower end of the first upper sliding block has a first lower slope surface, the first lower slope surface tilts towards one side of the limit sleeve, a lower end of the first lower sliding block has a first upper slope surface whose shape matches a shape of the first lower slope surface, and the first upper slope surface abuts on the first lower slope surface.

Accordingly, the limiting component is a clamping boss, the clamping boss is located at the lower end of the center rod, and the clamping boss and an end portion of a rod body of the center rod form a platform structure.

Accordingly, the rod body of the center rod partially or completely extends towards from an end of the clamping boss to form a truncated cone-shaped structure, and a surface of a smaller end of the truncated cone-shaped structure faces downwards.

Accordingly, a clamping tongue is disposed on an inner side of the limit sleeve, the limiting component is a bayonet, and the clamping tongue is inserted into the bayonet to implement locking and fitting.

Accordingly, the bottom plate includes a bottom plate upper portion and a bottom plate lower portion that are fixedly connected, an accommodation cavity is disposed between the bottom plate upper portion and the bottom plate lower portion, the bottom plate upper portion has a jack that communicates with the accommodation cavity, the jack is used to connect the center rod, and the limit sleeve is slidably connected in the accommodation cavity.

Accordingly, the first elastic element is a first reset spring, the first reset spring is located between the limit sleeve and the bottom plate, and the first reset spring and the clamping tongue are further located on a same side of the limit sleeve.

Accordingly, the wrench assembly is rotatably connected to the bottom plate by using a pin shaft, and a reset torsion spring is sleeved on the pin shaft.

Accordingly, the center rod includes a telescopic rod and a sleeve tube sleeved outside the telescopic rod, an upper end of the telescopic rod and an upper end of the sleeve tube are both fittingly connected to the top plate, the bayonet is disposed at a lower end of the telescopic rod, a lower end of the sleeve tube has a socket corresponding to the bayonet, and when the telescopic rod telescopes, the sleeve tube is inserted into the bottom plate and the limit sleeve, and the clamping tongue is inserted into the socket and the bayonet.

A new central locking apparatus for a folding tent includes a top plate, a bottom plate assembly, and a center rod disposed between the top plate and the bottom plate assembly. The bottom plate assembly includes a bottom plate, a wrench, and a second upper sliding block, the wrench is rotatably connected to the bottom plate, the second upper sliding block is slidably connected in the bottom plate, a second elastic element is fittingly disposed between one side of the second upper sliding block and the bottom plate, a clamping tongue is disposed on another side of the second upper sliding block, the wrench is capable of driving the second upper sliding block to slide, a bayonet is disposed at a lower end of the center rod, the lower end of the center rod is inserted into the bottom plate, and the clamping tongue is inserted into the bayonet.

Accordingly, a second lower sliding block is disposed between the wrench and the second upper sliding block, the second lower sliding block is capable of sliding up and down in the bottom plate, the second lower sliding block abuts on the second upper sliding block, and when the second lower sliding block slides upwards, the second lower sliding block is capable of pushing the second upper sliding block to slide to the second elastic element.

Accordingly, a lower end of the second upper sliding block has a second lower slope surface, a back of the second lower slope surface tilts towards one side of the clamping tongue, an upper end of the second lower sliding block has a second upper slope surface whose shape matches a shape of the second lower slope surface, and the second upper slope surface abuts on the second lower slope surface.

Accordingly, one end, of the wrench, abutting on the second lower sliding block is set as a cam.

Accordingly, the bottom plate includes a bottom plate upper portion and a bottom plate lower portion that are fixedly connected, an accommodation cavity is disposed between the bottom plate upper portion and the bottom plate lower portion, the bottom plate upper portion has a jack that communicates with the accommodation cavity, the jack is used to connect the center rod, and the second upper sliding block is slidably connected in the accommodation cavity.

Accordingly, the second elastic element is a second reset spring.

Accordingly, the wrench is rotatably connected to the bottom plate by using a pin shaft, and a reset torsion spring is sleeved on the pin shaft.

Accordingly, the center rod includes a telescopic rod and a sleeve tube sleeved outside the telescopic rod, an upper end of the telescopic rod and an upper end of the sleeve tube are both fittingly connected to the top plate, the bayonet is disposed at a lower end of the telescopic rod, a lower end of the sleeve tube has a socket corresponding to the bayonet, and when the telescopic rod telescopes, the sleeve tube is inserted into the bottom plate and the limit sleeve, and the clamping tongue is inserted into the socket and the bayonet.

Compared with the prior art, the present invention has an ingenious design, and can be operated with one hand, thereby bringing great convenience to users.

DESCRIPTION OF THE EMBODIMENTS

Figure 1:
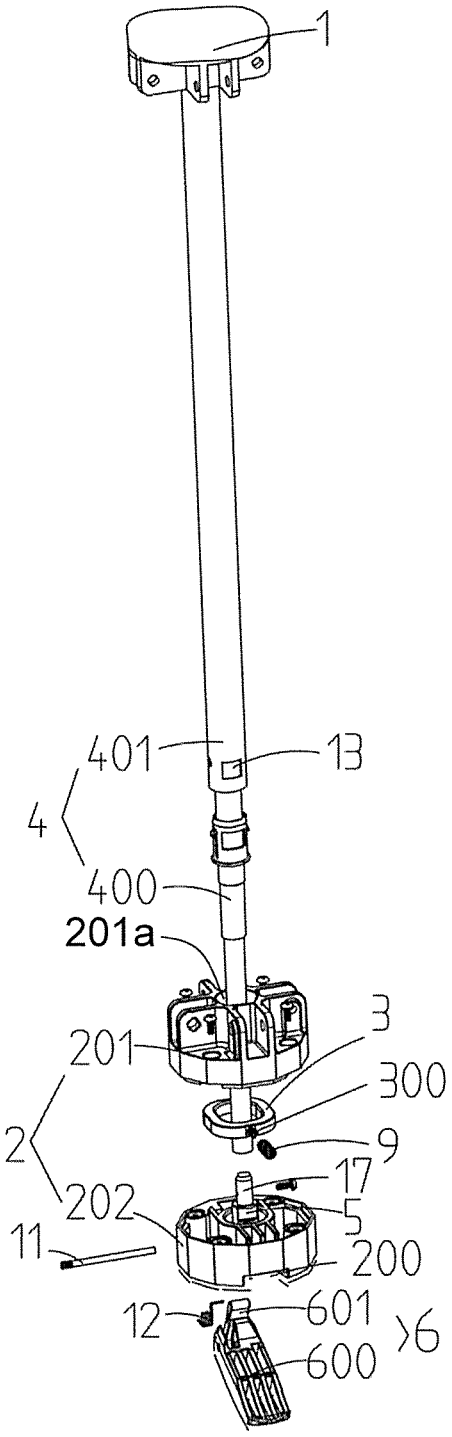
FIG. 1 is a schematic diagram of an exploded structure according to an embodiment 1.
Figure 2:
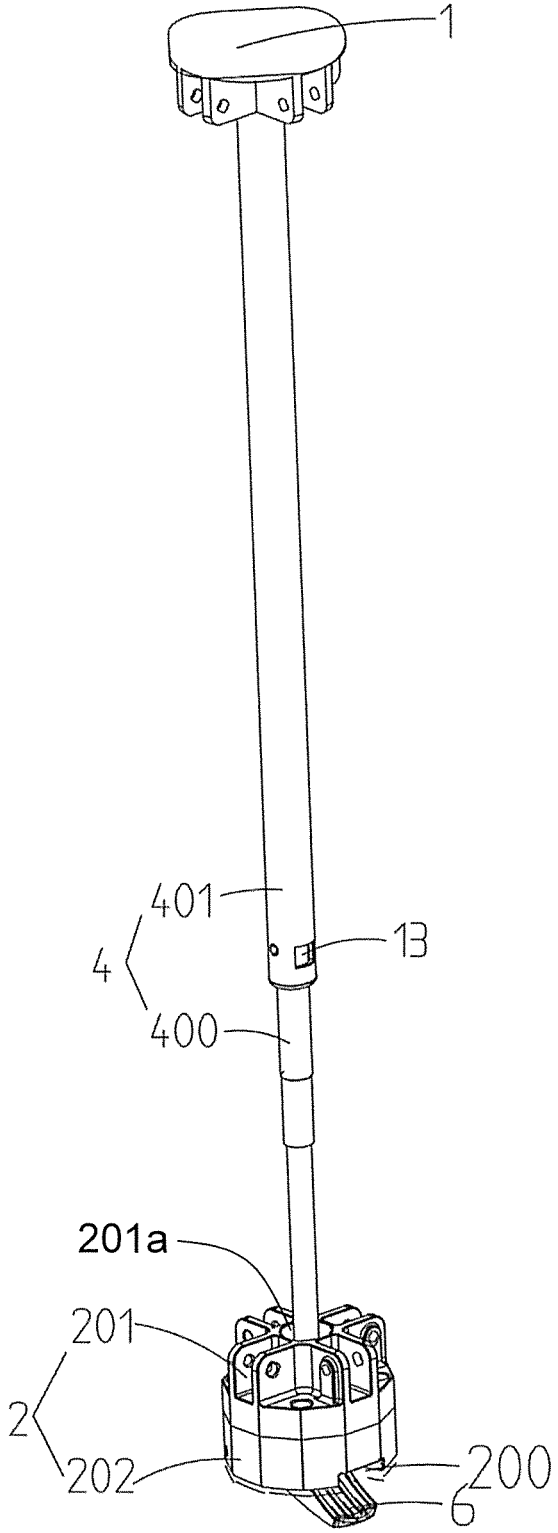
FIG. 2 is a schematic structural diagram in an unlocked state according to the embodiment 1.
Figure 3:
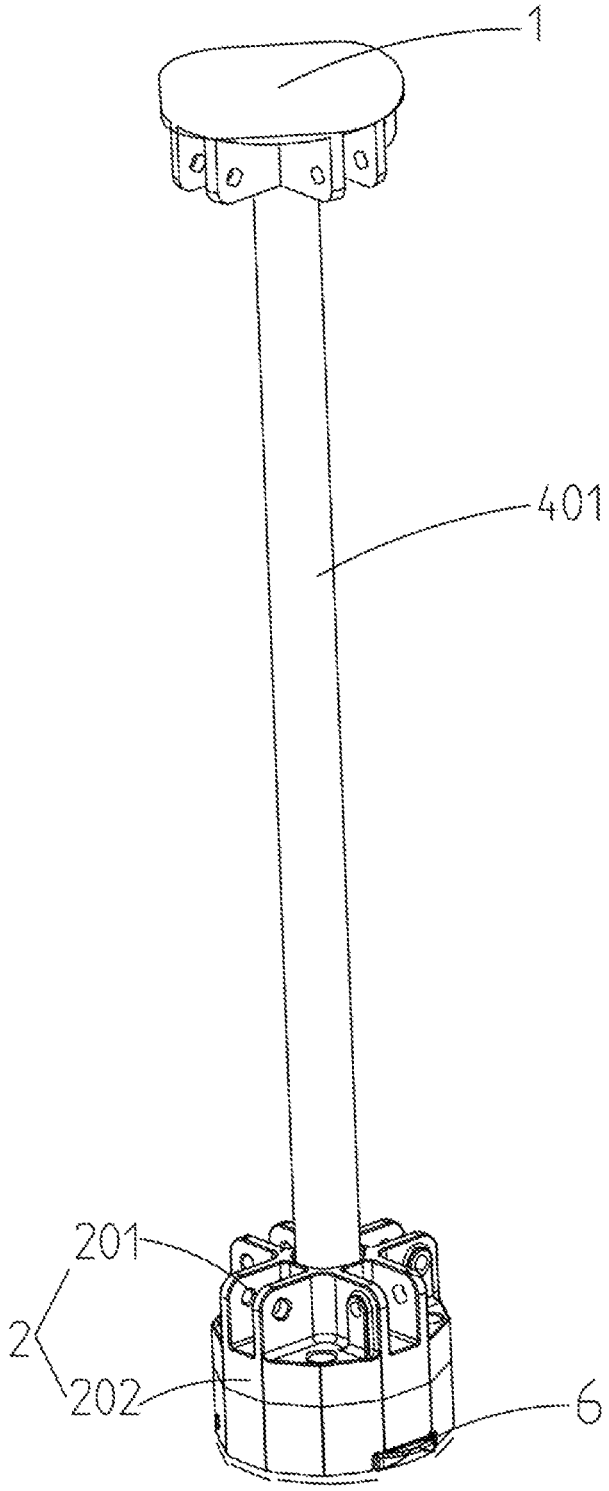
FIG. 3 is a schematic structural diagram in a locked state according to the embodiment 1.
Figure 4:
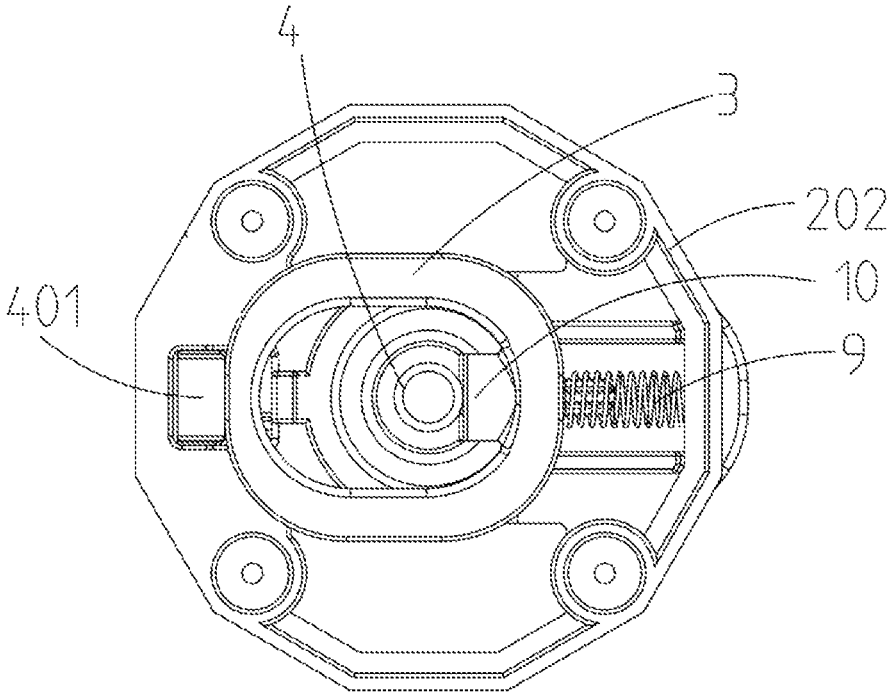
FIG. 4 is a schematic diagram of a top view structure of a bottom plate lower portion in the embodiment 1.
Figure 5:
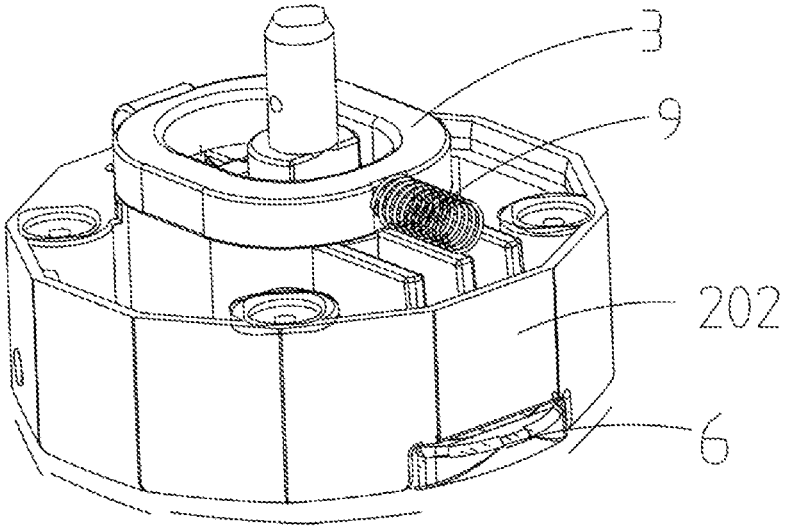
FIG. 5 is a schematic structural diagram of the bottom plate lower portion in the embodiment 1.
Figure 6:
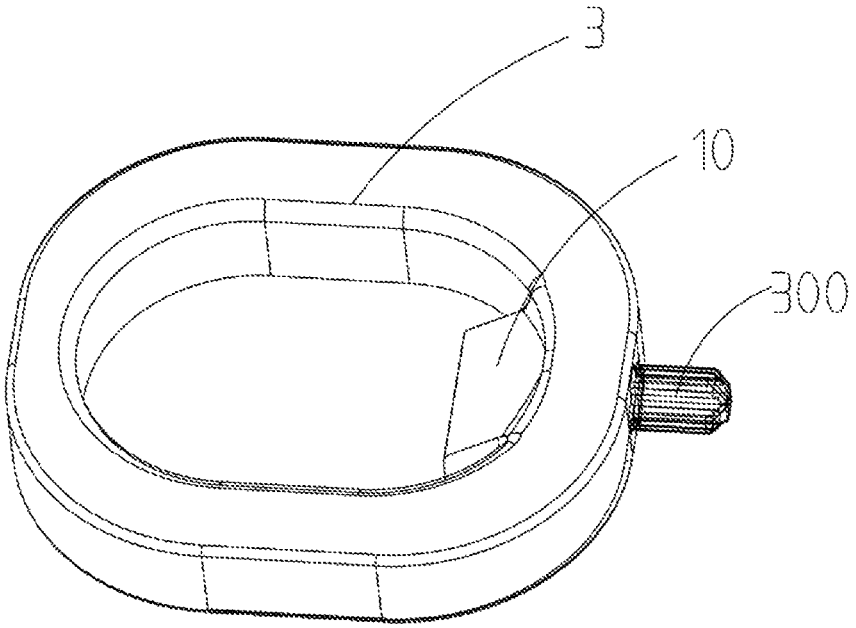
FIG. 6 is a schematic structural diagram of a limit sleeve in the embodiment 1.
Figure 7:
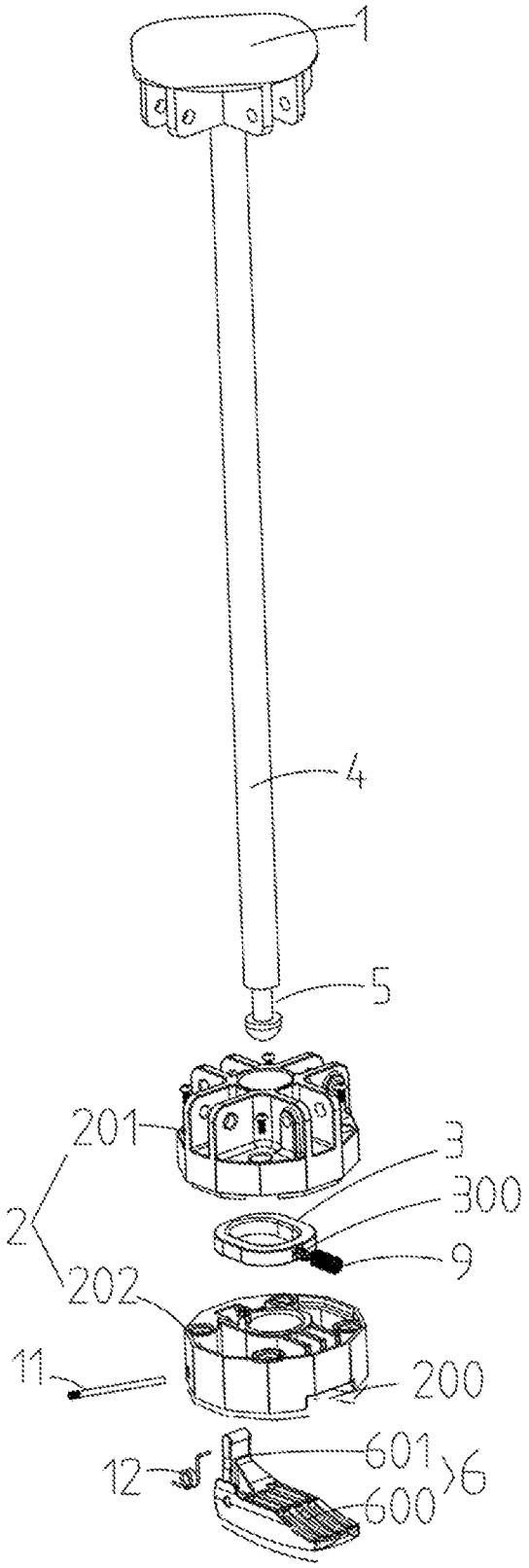
FIG. 7 is a schematic diagram of an exploded structure according to an embodiment 2.
Figure 8:
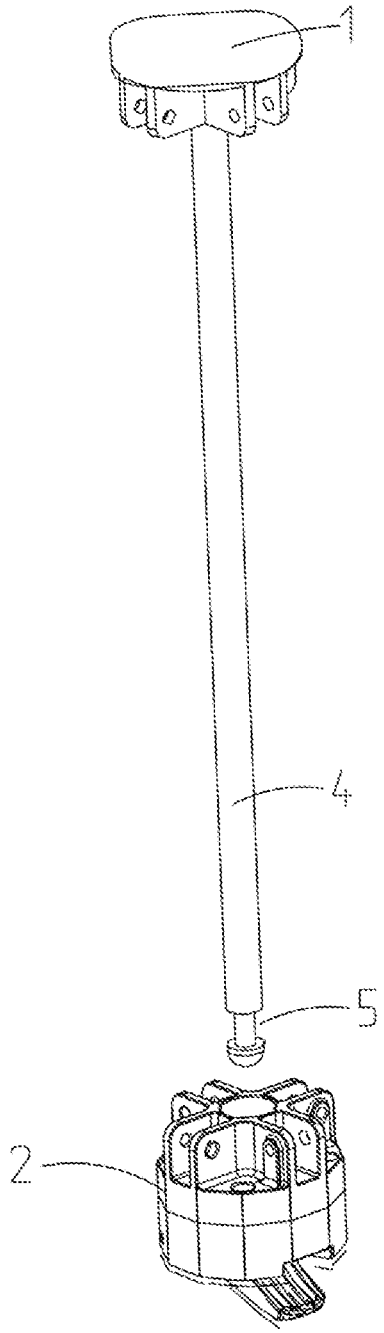
FIG. 8 is a schematic structural diagram in an unlocked state according to the embodiment 2.
Figure 9:
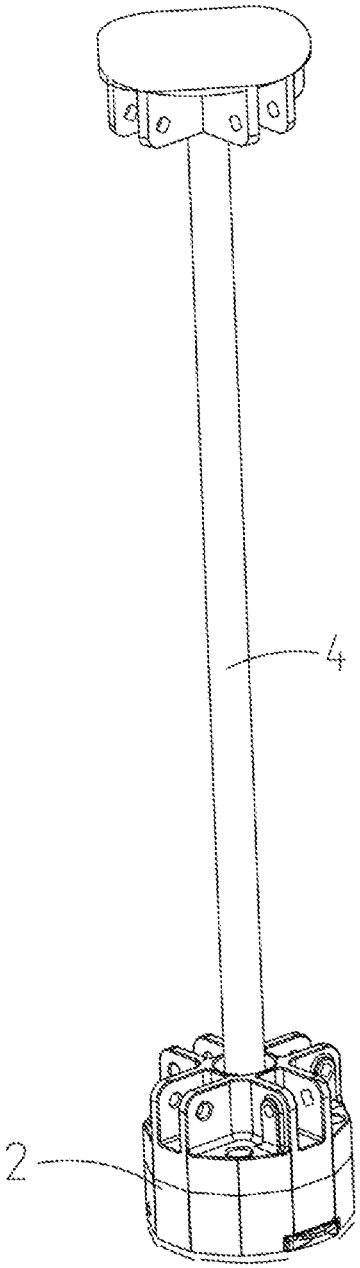
FIG. 9 is a schematic structural diagram in a locked state according to the embodiment 2.
Figure 10:
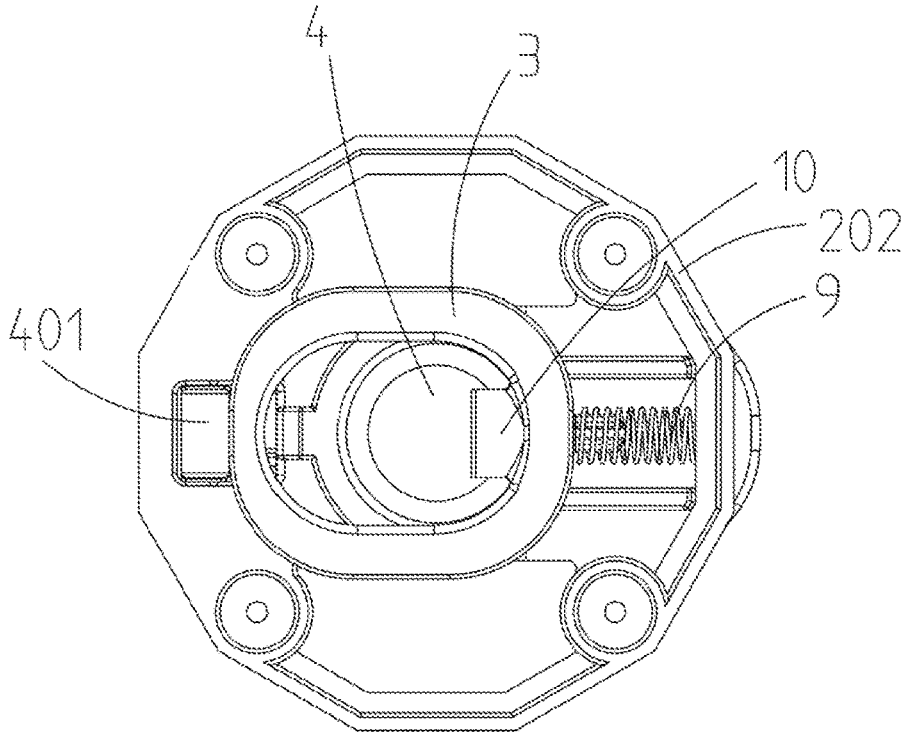
FIG. 10 is a schematic diagram of a top view structure of a bottom plate lower portion in the embodiment 2.
Figure 11:
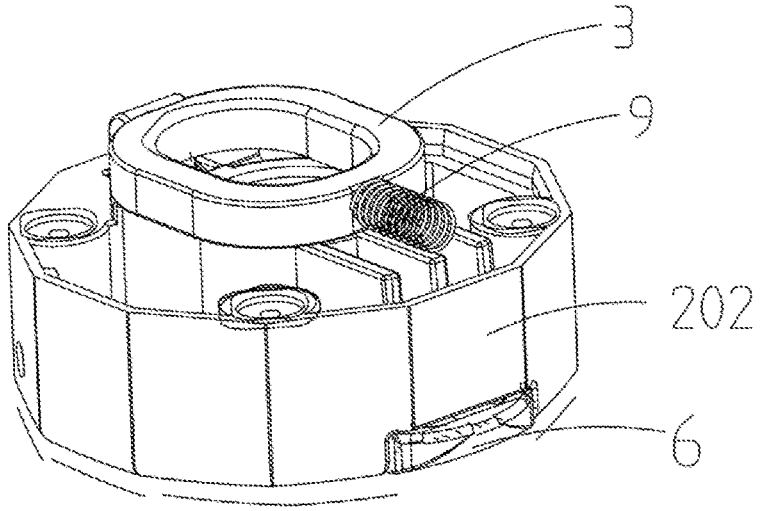
FIG. 11 is a schematic structural diagram of the bottom plate lower portion in Embodiment 2.
Figure 12:
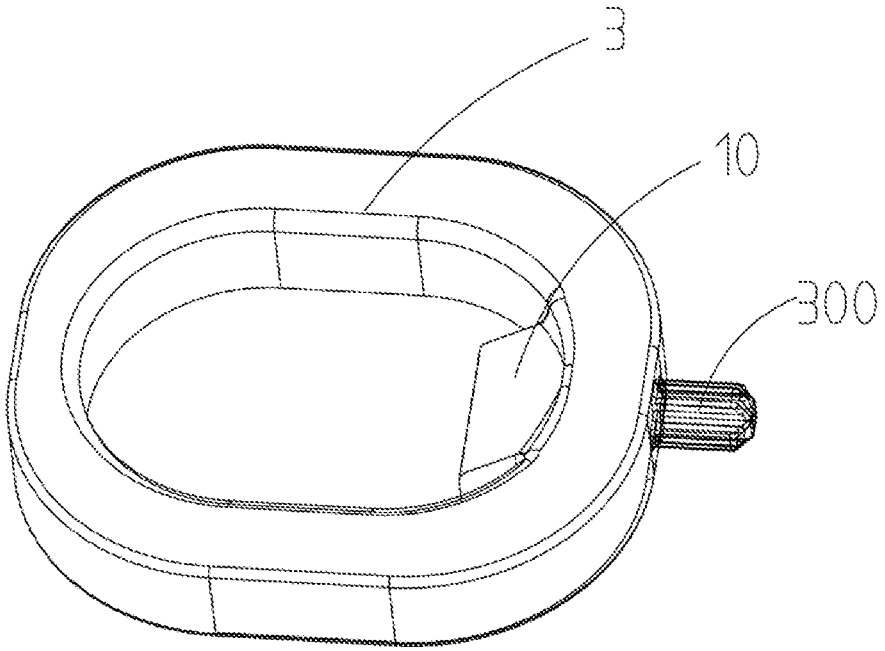
FIG. 12 is a schematic structural diagram of a limit sleeve in the embodiment 2.
Figure 13:
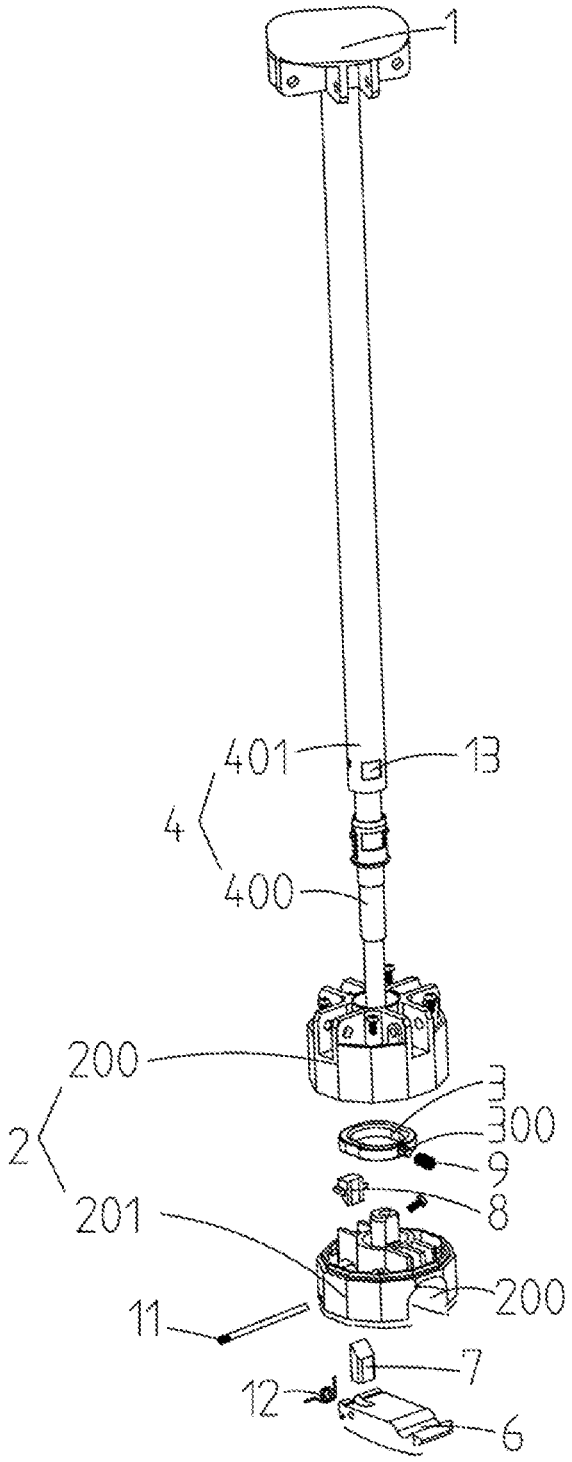
FIG. 13 is a schematic diagram of an exploded structure according to an embodiment 3.
Figure 14:
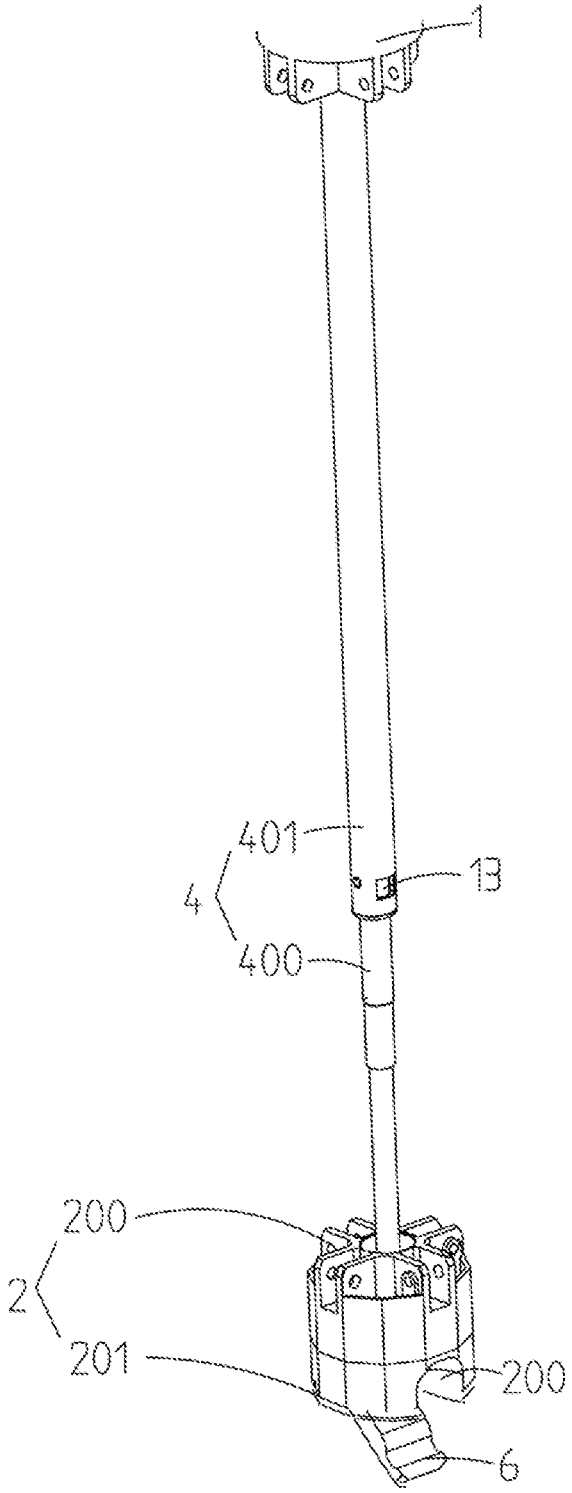
FIG. 14 is a schematic structural diagram in an unlocked state according to the embodiment 3.
Figure 15:
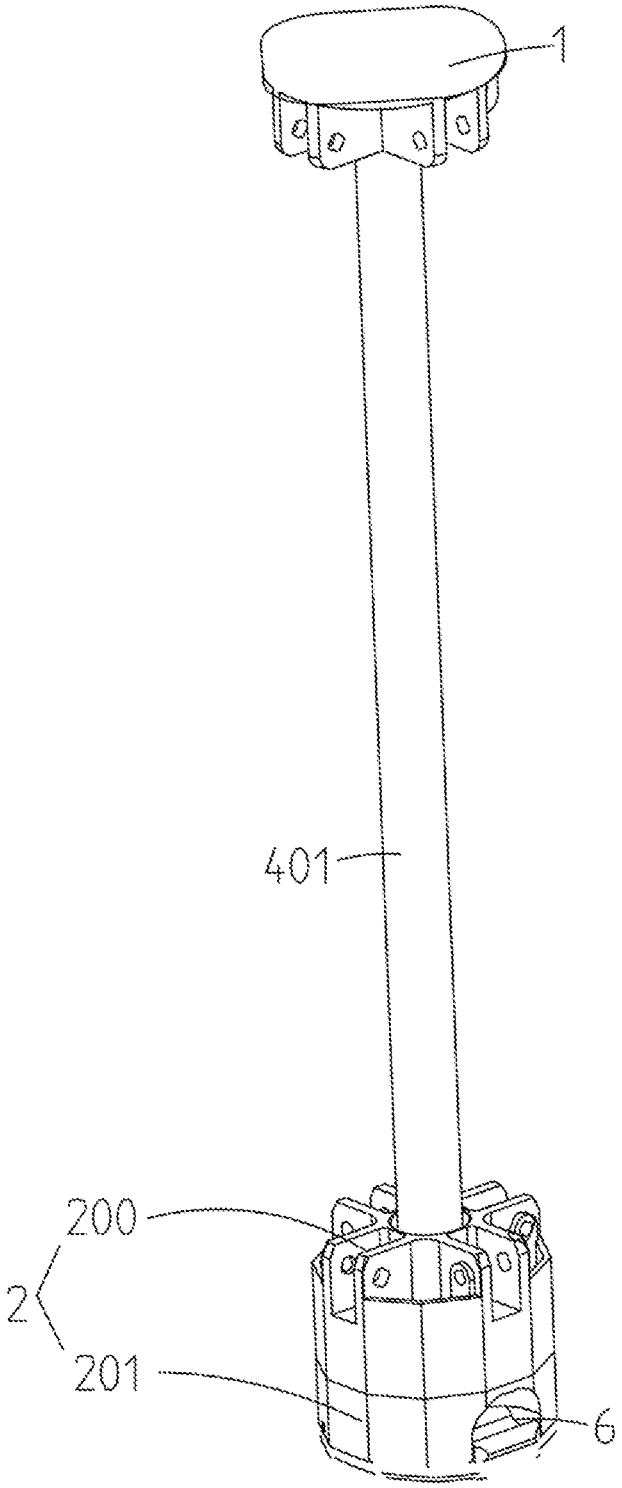
FIG. 15 is a schematic structural diagram in a locked state according to the embodiment 3.
Figure 16:
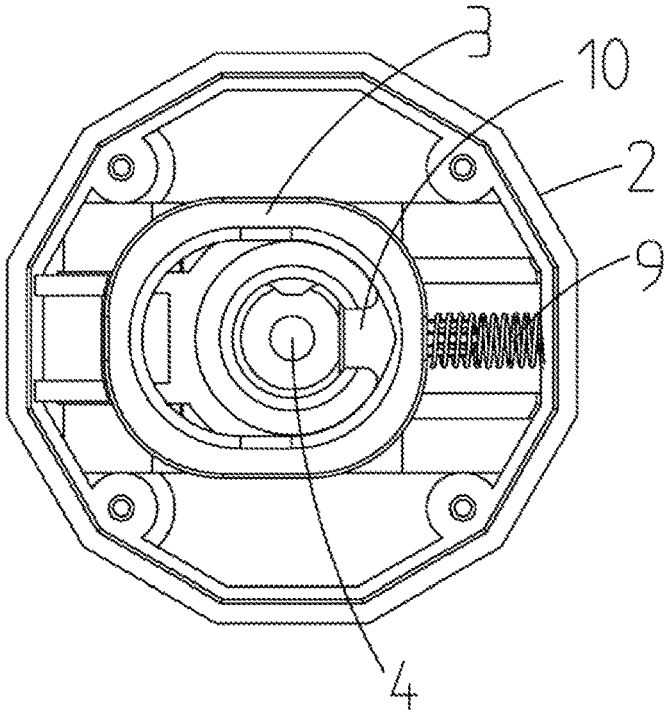
FIG. 16 is a schematic diagram of a top view structure of a bottom plate lower portion in the embodiment 3.
Figure 17:
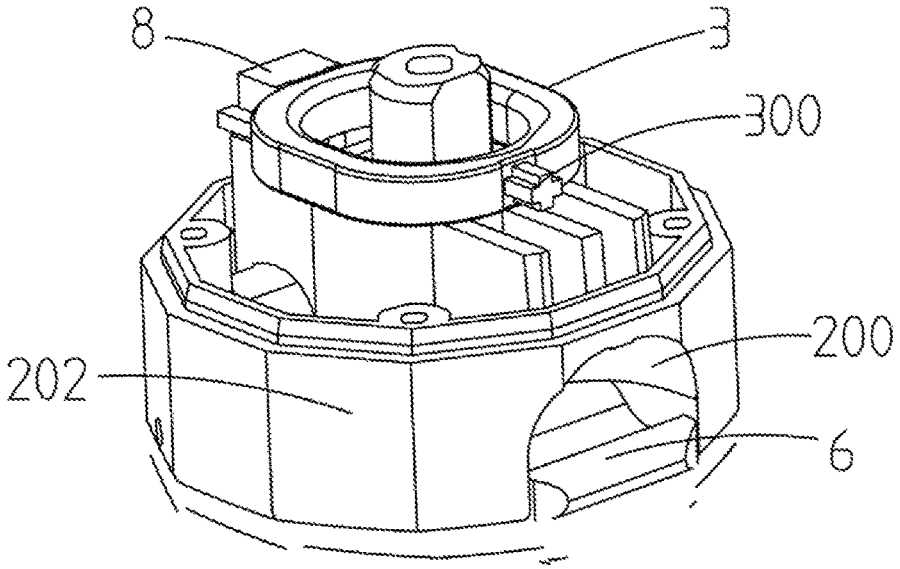
FIG. 17 is a schematic structural diagram of the bottom plate lower portion in the embodiment 3.
Figure 18:
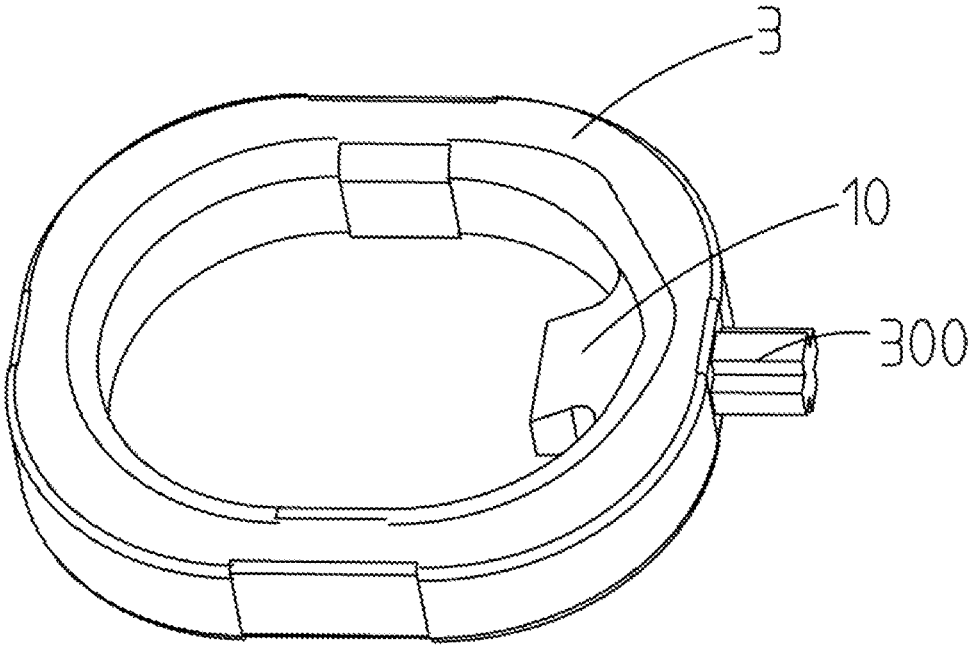
FIG. 18 is a schematic structural diagram of a limit sleeve in the embodiment 3.
Figure 19:
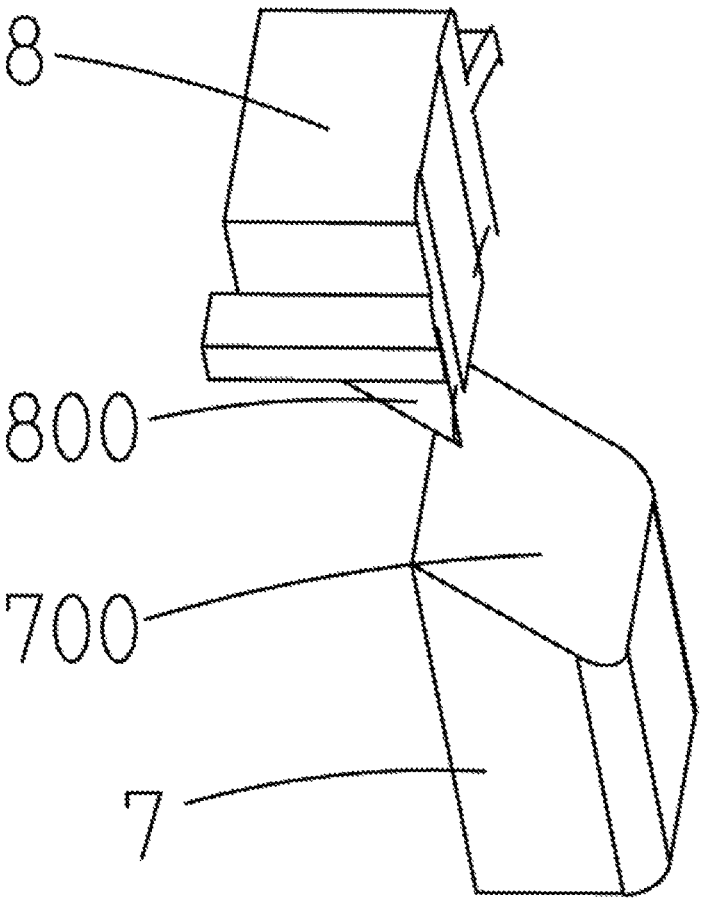
FIG. 19 is a schematic structural diagram of a first upper sliding block and a first lower sliding block in the embodiment 3.
Figure 20:
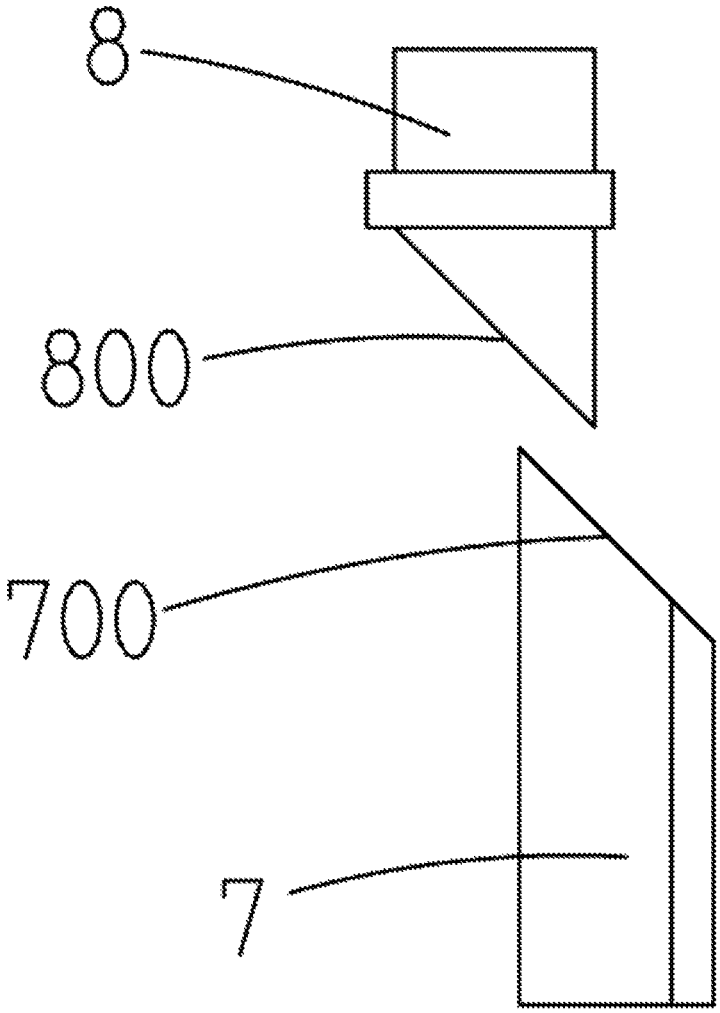
FIG. 20 is another schematic structural diagram of the first upper sliding block and the first lower sliding block in the embodiment 3.
Figure 21:
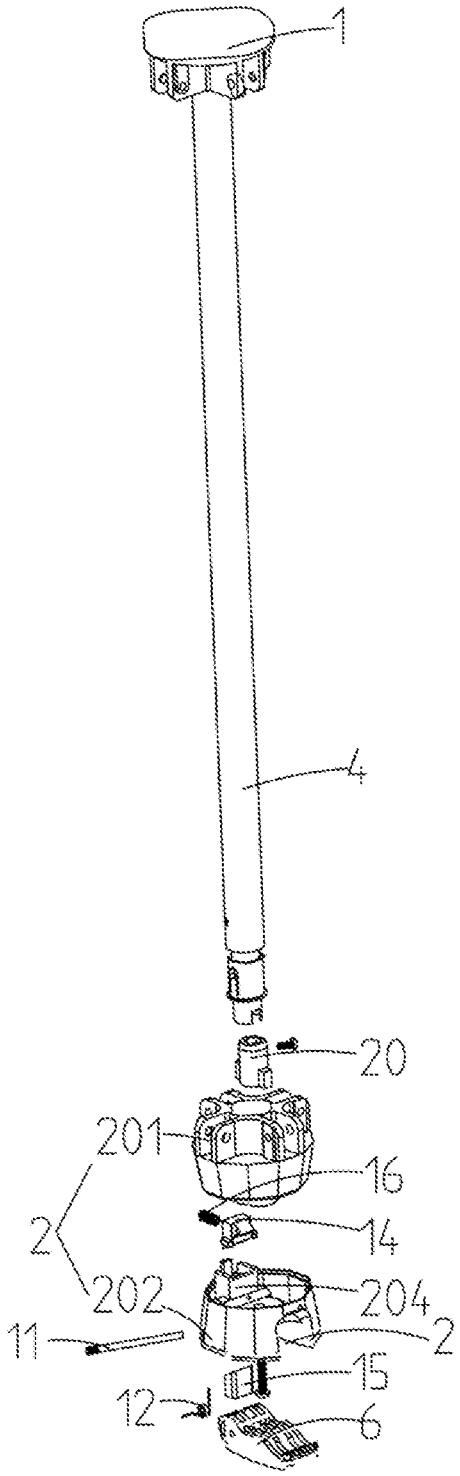
FIG. 21 is a schematic diagram of an exploded structure according to an embodiment 4.
Figure 22:
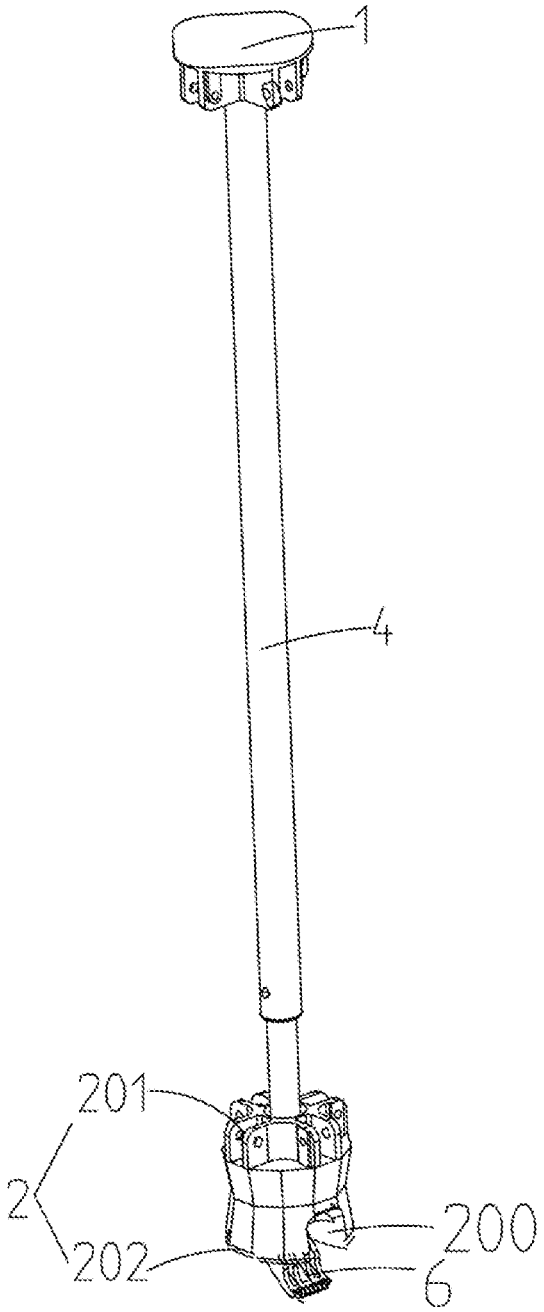
FIG. 22 is a schematic structural diagram in an unlocked state according to the embodiment 4.
Figure 23:
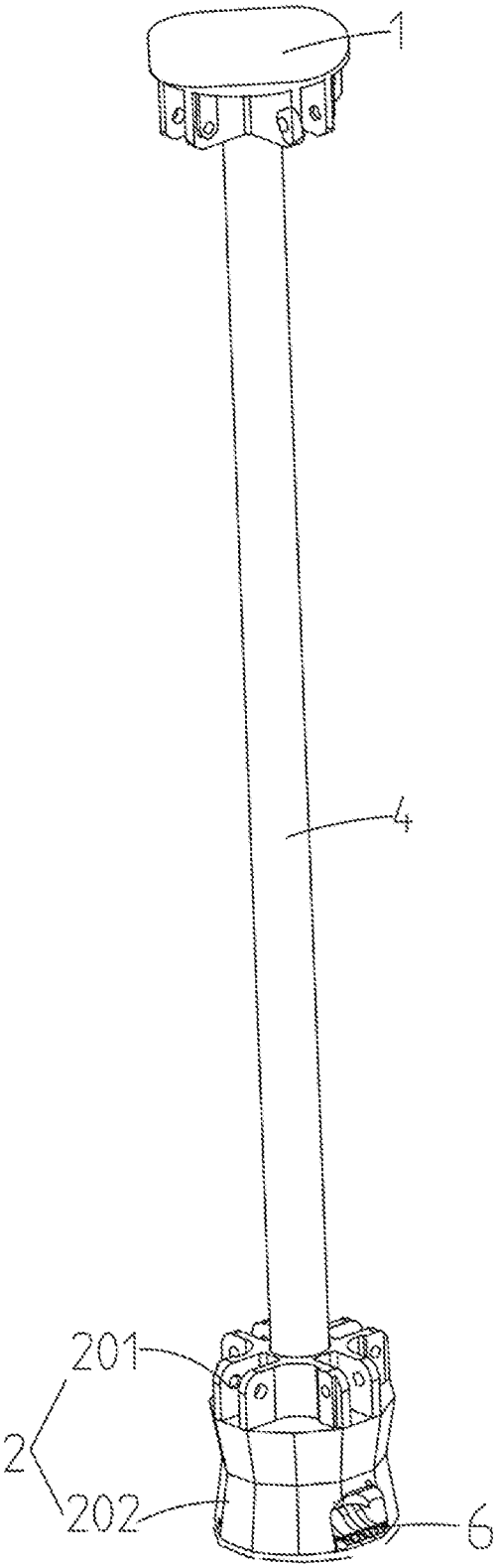
FIG. 23 is a schematic structural diagram in a locked state according to the embodiment 4.
Figure 24:
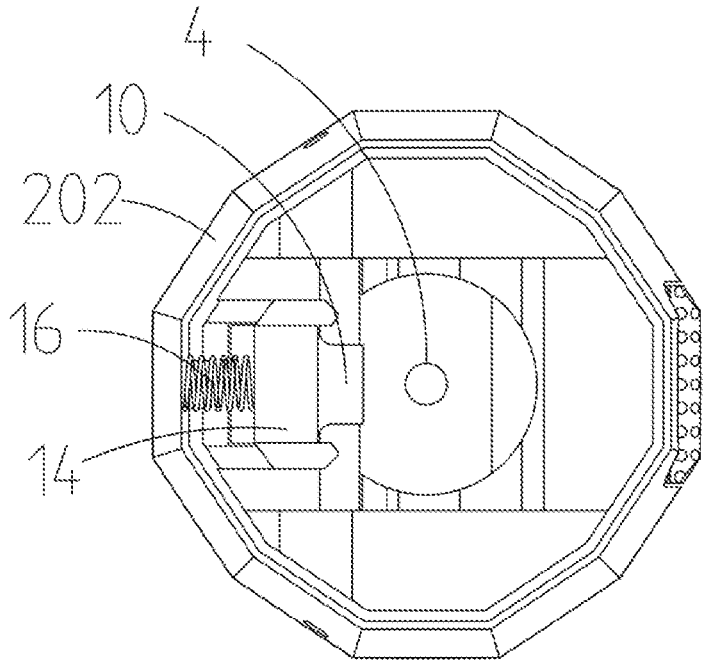
FIG. 24 is a schematic diagram of a top view structure of a bottom plate lower portion in the embodiment 4.
Figure 25:
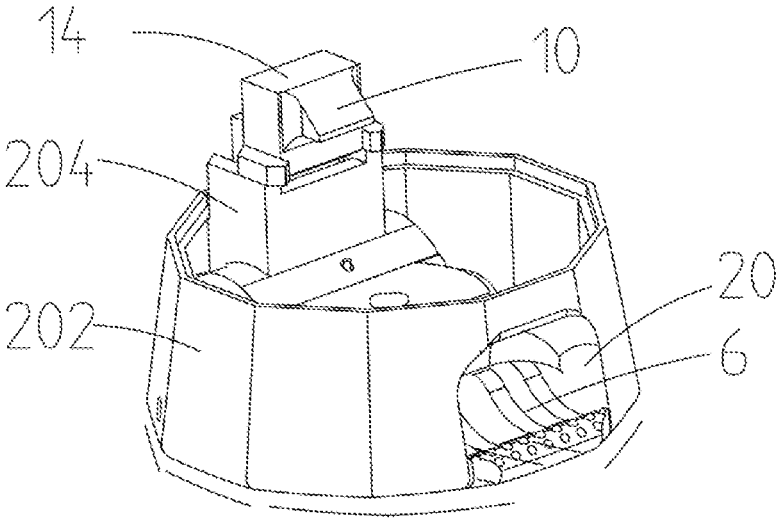
FIG. 25 is a schematic structural diagram of a bottom plate lower portion in the embodiment 4.
Figure 26:
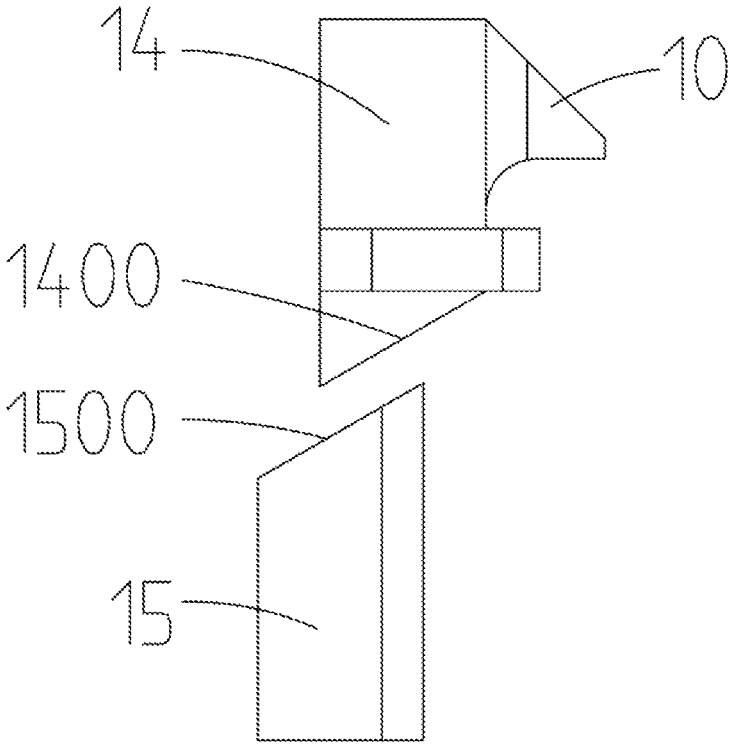
FIG. 26 is a schematic structural diagram of a first upper sliding block and a first lower sliding block in the embodiment 4.
Figure 27:
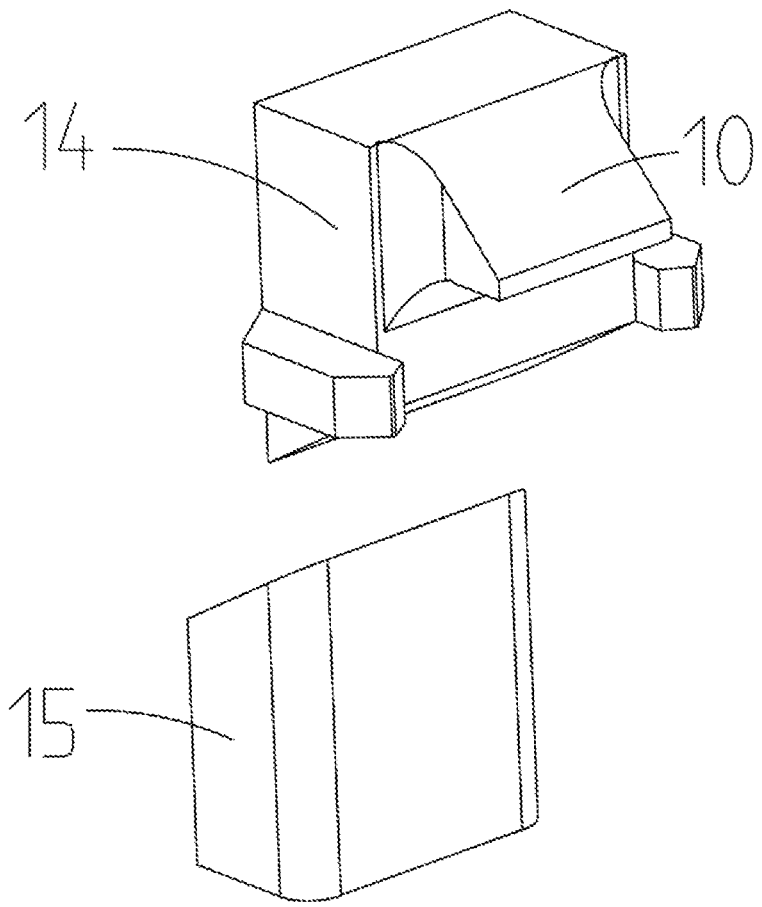
FIG. 27 is another schematic structural diagram 2 of the first upper sliding block and the first lower sliding block in the embodiment 4.
Figure 28:
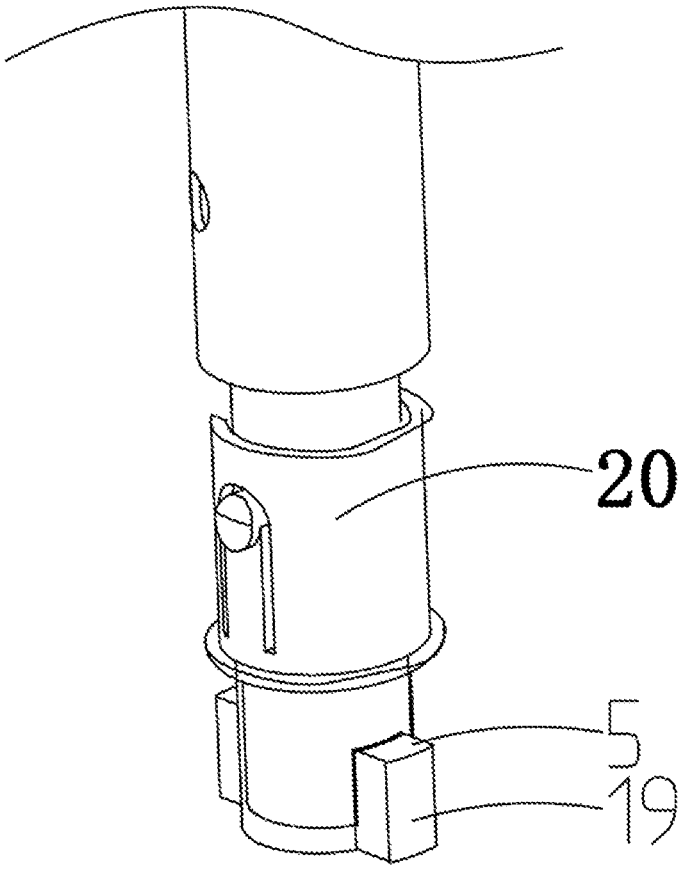
FIG. 28 is a partially enlarged view of FIG. 21.

The present invention is further described below with reference to the accompanying drawings.

Embodiment 1

As shown in FIG. 1 to FIG. 6, a central locking apparatus for a folding tent includes a top plate 1, a bottom plate assembly, and a center rod 4 disposed between the top plate 1 and the bottom plate assembly. The bottom plate assembly includes a bottom plate 2, a wrench assembly rotatably connected to the bottom plate 2, and a limit sleeve 3 slidably connected in the bottom plate 2. The wrench assembly abuts on the limit sleeve 3. The wrench assembly is capable of driving the limit sleeve 3 to slide. A limiting component is disposed at a lower end of the center rod 4, and the limiting component may be built into the bottom plate 2 to fit the limit sleeve 3 in a locking manner. A clamping tongue 10 is disposed on an inner side of the limit sleeve 3, and a surface of an upper end of the clamping tongue 10 is a slope surface that tilts towards an interior of the limit sleeve 3. A bayonet 5 is disposed at the lower end of the center rod 4. The bayonet 5 is a limiting component. The lower end of the center rod 4 is inserted into the bottom plate 2 and the limit sleeve 3. The clamping tongue 10 is inserted into the bayonet 5. A first elastic element is fittingly disposed between the limit sleeve 3 and the bottom plate 2.

Wrench assembly. The wrench assembly includes a wrench 6, and the wrench 6 includes a wrench operation portion 600 and a wrench execution portion 601 that are fixedly connected. The wrench operation portion 600 is located on a groove 200 on an outer side of a bottom portion of the bottom plate 2, so that the wrench operation portion 600 can be manually moved downwards. The wrench execution portion 601 is located in the bottom plate 1 and abuts on the limit sleeve 3. The connection portion between the wrench operation portion 600 and the wrench execution portion 601 is rotatably connected to the bottom plate 2 by using a pin shaft 11, and a reset torsion spring 12 is sleeved on the pin shaft 11 in a known manner.

Bottom plate. The bottom plate 2 includes a bottom plate upper portion 201 and a bottom plate lower portion 202 that are fixedly connected. An accommodation cavity is disposed between the bottom plate upper portion 201 and the bottom plate lower portion 202, the bottom plate upper portion 201 has a jack 201*a* that communicates with the accommodation cavity, the jack 201*a* is used to connect the center rod 4, and the limit sleeve 3 is slidably connected in the accommodation cavity. To limit movement of the limit sleeve 3, a lower end of the bottom plate upper portion 201 is further fixedly connected to a limit ring, and the limit sleeve 3 is located on the limit ring.

First elastic element. The first elastic element is a first reset spring 9, the first reset spring 9 is located between the limit sleeve 3 and the bottom plate 2, and the first reset spring 9 and the clamping tongue 10 are further located on a same side of the limit sleeve 3. To prevent the first reset spring 9 from falling off, a limit sleeve fixing column 300 is fixedly connected to a corresponding side of the limit sleeve 3, and the first reset spring 9 is sleeved on the limit sleeve fixing column 300.

Center rod. The center rod 4 includes a telescopic rod 400 and a sleeve tube 401 sleeved outside the telescopic rod 400, an upper end of the telescopic rod 400 and an upper end of the sleeve tube 401 are both fixedly connected to the top plate 1 in a known manner, the bayonet 5 is disposed at a lower end of the telescopic rod 400, a lower end of the sleeve tube 401 has a socket 13 corresponding to the bayonet 5, and when the telescopic rod 400 telescopes, the sleeve tube 401 is inserted into the bottom plate 2 and the limit sleeve 3, and the clamping tongue 10 is inserted into the socket 13 and the bayonet 5.

Further manner of disposing the bayonet. The lower end of the telescopic rod 400 is inserted into a cylindrical connection block 17, side surfaces of the lower end of the telescopic rod 400 and the cylindrical connection block 17 are fastened by using screws, a lower end of the connection block has a step surface, and the step surface and a surface of the lower end of the telescopic rod 400 form the bayonet 5.

In a locked state, the lower end of the telescopic rod 400 and a lower end of the sleeve tube 401 are inserted into the bottom plate 2 and the limit sleeve 3. Because the surface of the upper end of the clamping tongue 10 is a slope surface, the clamping tongue 10 automatically telescopes, and then is inserted into the socket 13 and the bayonet 5 under an action of the first reset spring 9.

In an unlocked state, the wrench 6 is moved downwards, and the wrench 6 drives the limit sleeve 3 to slide towards a side of the first reset spring 9, so that the clamping tongue 10 exits the socket 13 and the bayonet 5 to achieve unlocking. The center rod 4 is pulled out, the wrench 6 is released, the wrench 6 is reset due to acting force of the reset torsion spring 12, and the limit sleeve 3 is reset under an action of the first reset spring 9.

Embodiment 2

As shown in FIG. 7 to FIG. 12, a difference between the embodiment 2 and the embodiment 1 is that the center rod 4 in the embodiment 2 is non-telescopic, the lower end of the center rod 4 is provided with a connection end 18, the connection end and the center rod 4 are of an integrated structure, the connection end 18 includes a rod portion and a head portion, and a diameter of the rod portion is less than a diameter of the head portion and a diameter of the center rod 4. Therefore, the bayonet 5 is formed on the rod portion.

In a locked state, the connection end 18 of the center rod 4 is inserted into the bottom plate 2 and the limit sleeve 3. Because the surface of the upper end of the clamping tongue 10 is a slope surface, the clamping tongue 10 automatically telescopes, and then is inserted into the bayonet 5 under an action of the first reset spring 9.

In the unlocked state, the wrench 6 is moved downwards, and the wrench 6 drives the limit sleeve 3 to slide towards a side of the first reset spring 9, so that the clamping tongue 10 exits the bayonet 5 to achieve unlocking. The center rod 4 is pulled out, the wrench 6 is released, the wrench 6 is reset due to acting force of the reset torsion spring 12, and the limit sleeve 3 is reset under an action of the first reset spring 9.

Embodiment 3

As shown in FIG. 13 to FIG. 20, a difference between the embodiment 3 and the embodiment 1 is as follows.

A wrench assembly in the embodiment 3 includes the wrench 6, a first lower sliding block 7, and a first upper sliding block 8. The wrench 6 is located on the groove 200 on the outer side of the bottom portion of the bottom plate 2. The first lower sliding block 7 is connected to the bottom plate 2 in a manner of sliding up and down. The first upper sliding block 8 is located at an upper end of the first lower sliding block 7 and abuts on the upper end of the first lower sliding block 7, the first upper sliding block 8 abuts on a limit sleeve 3, and the first upper sliding block 8 is connected to the bottom plate 2 in a manner of sliding left and right. When the first lower sliding block 7 slides upwards, the first lower sliding block 7 is capable of pushing the first upper sliding block 8 to slide towards the limit sleeve 3. To drive the first lower sliding block 7 to move upwards, one end, of the wrench 6, abutting on the first lower sliding block 7 is of a cam structure.

Specific structure of the first upper sliding block and the first lower sliding block. A lower end of the first upper sliding block 8 has a first lower slope surface 800, the first lower slope surface 800 tilts towards one side of the limit sleeve 3, a lower end of the first lower sliding block 7 has a first upper slope surface 700 that is parallel with the first lower slope surface 800, and the first upper slope surface 700 abuts on the first lower slope surface 800.

To enable the first upper sliding block 8 to more steadily slide, a fixing base 204 is fixedly connected to the bottom plate lower portion 202, two sides of the first upper sliding block 8 are fixedly connected to two wings, the first upper sliding block 8 slides on the fixing base 204, and lower ends of the two wings abut on the fixing base 204.

In the locked state, the lower end of the telescopic rod 400 and the lower end of the sleeve tube 401 are inserted into the bottom plate 2 and the limit sleeve 3. Because the surface of the upper end of the clamping tongue 10 is a slope surface, the clamping tongue 10 automatically telescopes, and then is inserted into a socket 13 and the bayonet 5 under an action of the first reset spring 9.

In the unlocked state, the wrench 6 is moved downwards, and the wrench 6 drives the first lower sliding block 7 to slightly slide upwards. The first lower sliding block 7 drives the first upper sliding block 8 to slide towards the limit sleeve 3, so that the clamping tongue 10 exits the socket 13 and the bayonet 5 to achieve unlocking. The center rod 4 is pulled out, the wrench 6 is released, the wrench 6 is reset due to acting force of a reset torsion spring 12, and the limit sleeve 3 is reset under an action of the first reset spring 9.

Embodiment 4

As shown in FIG. 21 to FIG. 28, a central locking apparatus for a folding tent includes the top plate 1, the bottom plate assembly, and the center rod 4 disposed between the top plate 1 and the bottom plate assembly. The bottom plate assembly includes the bottom plate 2, the wrench 6, a second upper sliding block 14, and a second lower sliding block 15. The wrench 6 is rotatably connected to the bottom plate 2, and the second upper sliding block 14 is connected in the bottom plate 2 in a manner of sliding left and right. A second elastic element is fittingly disposed between one side of the second upper sliding block 14 and the bottom plate 2, and a clamping tongue 10 is disposed on another side of the second upper sliding block 14. The second lower sliding block 15 is capable of sliding up and down in the bottom plate 2, and the second lower sliding block 15 abuts on the second upper sliding block 14. When the second lower sliding block 15 slides upwards, the second lower sliding block 15 is capable of pushing the second upper sliding block 14 to slide to the second elastic element. The wrench 6 is capable of driving the second lower sliding block 15 to slide upwards, the bayonet 5 is disposed at the lower end of the center rod 4, the lower end of the center rod 4 is inserted into the bottom plate 2, and the clamping tongue 10 is inserted into the bayonet 5.

Specific structure of the second upper sliding block and the second lower sliding block. A lower end of the second upper sliding block 14 has a second lower slope surface 1400, a back of the second lower slope surface 1400 tilts towards one side of the clamping tongue 10, an upper end of the second lower sliding block 15 has a second upper slope surface 1500 that is parallel with the second lower slope surface 1400, and the second upper slope surface 1500 abuts on the second lower slope surface 1500.

Bottom plate. The bottom plate 2 includes the bottom plate upper portion 201 and the bottom plate lower portion 202 that are fixedly connected. An accommodation cavity is disposed between the bottom plate upper portion 201 and the bottom plate lower portion 202, the bottom plate upper portion 201 has the jack 201*a* that communicates with the accommodation cavity, the jack 201*a* is used to connect the center rod 4, and the second upper sliding block 14 is slidably connected in the accommodation cavity. To limit movement of the limit sleeve 3, the lower end of the bottom plate upper portion 201 is further fixedly connected to a limit ring, and the limit sleeve 3 is located on the limit ring.

Second elastic element. The second elastic element is a second reset spring 16.

Wrench. The wrench 6 is located on the groove 200 on the outer side of the bottom portion of the bottom plate 2, so that the wrench 6 can be manually moved downwards. The wrench 6 is rotatably connected to the bottom plate 2 by using the pin shaft 11, and the reset torsion spring 12 is sleeved on the pin shaft 11 in a known manner. In addition, to enable the wrench 6 to drive the second lower sliding block 15 to move upwards, one end, of the wrench 6, abutting on the second lower sliding block 15 is set as a cam.

Further manner of disposing the bayonet. The lower end of the center rod 4 is fixedly inserted into a cylindrical connection block 20 by using a screw, two sides of the connection block 20 is fixedly connected to a stopping block 19, and the stopping block 19 and a step surface of the lower end of the center rod 4 form the bayonet 5.

In the locked state, the connection block 20 of the center rod 4 is inserted into the bottom plate 2. Because the surface of the upper end of the clamping tongue 10 is a slope surface, the clamping tongue 10 automatically telescopes, and then is inserted into the bayonet 5 under an action of a first reset spring 9.

In the unlocked state, the wrench 6 is moved downwards, and the wrench 6 drives the second lower sliding block 15 to slightly slide upwards. The second lower sliding block 15 drives a back of the second upper sliding block 14 to slide towards the bayonet 5, so that the clamping tongue 10 exits the bayonet 5 to achieve unlocking. The center rod 4 is pulled out, the wrench 6 is released, and the wrench 6 is reset due to acting force of the reset torsion spring 12.

Embodiment 5

Figure 29:
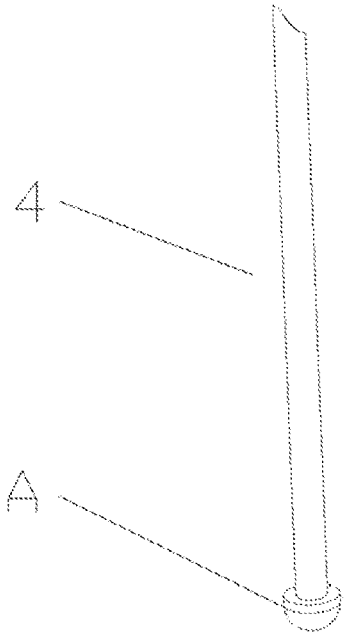
FIG. 29 is a schematic structural diagram of a center rod in an embodiment 5.

Based on the foregoing description, as shown in FIG. 29, in the central locking apparatus for the folding tent disclosed in this embodiment, the limiting component may be alternatively a clamping boss A, the clamping boss A is located at the lower end of the center rod 4, the clamping boss A and an end portion of a rod body of the center rod 4 form a platform structure, and the platform and a clamping tongue 10 achieve limiting and fitting, so as to complete locking.

Embodiment 6

Figure 30:
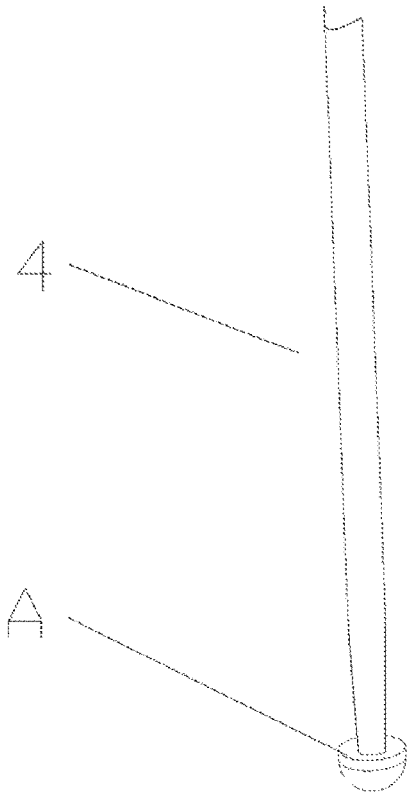
FIG. 30 is a schematic structural diagram of a center rod in an embodiment 6.

Based on the foregoing description, as shown in FIG. 30, in the central locking apparatus for the folding tent disclosed in this embodiment, the rod body of the center rod 4 partially or completely extends downwards from an end of a clamping boss A to form a truncated cone-shaped structure, and a surface of a smaller end of the truncated cone-shaped structure faces downwards.

The rod body of the center rod 4 uses the truncated cone-shaped design structure, thereby better facilitating limiting and fitting stability of the clamping tongue 10 and the platform, and further improving unlocking stability of the clamping tongue 10.

At last, it should be stated that the above various embodiments are only used to illustrate the technical solutions of the present invention, instead of limiting the technical solutions. Despite the present invention is described above in detail with reference to the aforementioned embodiments, a person of ordinary skill in the art should understand that the described technical solutions recorded in the above various embodiments may still be modified or some or all of technical features may be equivalently replaced, provided that these modifications or replacements do not make essence of corresponding technical solutions deviate from the scope of the technical solutions of the embodiments of the present invention.

What is claimed is:

1. A central locking apparatus for a folding tent, the central locking apparatus comprising a top plate, a bottom plate assembly, and a center rod disposed between the top plate and the bottom plate assembly, wherein the bottom plate assembly comprises a bottom plate, a wrench assembly rotatably connected to the bottom plate, and a limit sleeve slidably connected in the bottom plate, the wrench assembly abuts on the limit sleeve, the wrench assembly is capable of driving the limit sleeve to slide, a limiting component is disposed at a lower end of the center rod, the limiting component may be built into the bottom plate to fit the limit sleeve in a locking manner, and a first elastic element is fittingly disposed between the limit sleeve and the bottom plate, wherein the wrench assembly comprises a wrench, a first lower sliding block, and a first upper sliding block, the wrench (6) is located on a groove on an outer side of a bottom portion of the bottom plate, the first lower sliding block is connected to the bottom plate in a manner of sliding up and down, the first upper sliding block is located at an upper end of the first lower sliding block and abuts on the upper end, the first upper sliding block abuts on the limit sleeve, the first upper sliding block is connected to the bottom plate in a manner of sliding left and right, and when the first lower sliding block slides upwards, the first lower sliding block is capable of pushing the first upper sliding block to slide towards the limit sleeve.

2. The central locking apparatus for the folding tent according to claim 1, wherein the wrench comprises a wrench operation portion and a wrench execution portion that are fixedly connected, the wrench operation portion is located on a groove on an outer side of a bottom portion of the bottom plate, and the wrench execution portion is located in the bottom plate and abuts on the limit sleeve.

3. The central locking apparatus for the folding tent according to claim 1, wherein one end of the wrench, abutting on the first lower sliding block, is a cam structure.

4. The central locking apparatus for the folding tent according to claim 1, wherein a lower end of the first upper sliding block has a first lower slope surface, the first lower slope surface tilts towards one side of the limit sleeve, a lower end of the first lower sliding block has a first upper slope surface whose shape matches a shape of the first lower slope surface, and the first upper slope surface abuts on the first lower slope surface.

5. The central locking apparatus for the folding tent according to claim 1, wherein the limiting component is a clamping boss, the clamping boss is located at the lower end of the center rod, and the clamping boss and an end portion of a rod body of the center rod form a platform structure.

6. The central locking apparatus for the folding tent according to claim 5, wherein the rod body of the center rod partially or completely extends downwards from an end of the clamping boss to form a truncated cone-shaped structure, and a surface of a smaller end of the truncated cone-shaped structure faces downwards.

7. The central locking apparatus for the folding tent according to claim 1, wherein a clamping tongue is disposed on an inner side of the limit sleeve, the limiting component is a bayonet, and the clamping tongue is inserted into the bayonet to implement locking and fitting.

8. The central locking apparatus for the folding tent according to claim 7, wherein the first elastic element is a first reset spring, the first reset spring is located between the limit sleeve and the bottom plate, and the first reset spring and the clamping tongue are further located on a same side of the limit sleeve.

9. The central locking apparatus for the folding tent according to claim 7, wherein the center rod comprises a telescopic rod and a sleeve tube sleeved outside the telescopic rod, an upper end of the telescopic rod and an upper end of the sleeve tube are both fittingly connected to the top plate, the bayonet is disposed at a lower end of the telescopic rod, a lower end of the sleeve tube has a socket corresponding to the bayonet, and when the telescopic rod telescopes, the sleeve tube is inserted into the bottom plate and the limit sleeve, and the clamping tongue is inserted into the socket and the bayonet.

10. The central locking apparatus for the folding tent according to claim 1, wherein the bottom plate comprises a bottom plate upper portion and a bottom plate lower portion that are fixedly connected, an accommodation cavity is disposed between the bottom plate upper portion and the bottom plate lower portion, the bottom plate upper portion has a jack that communicates with the accommodation cavity, the jack is used to connect the center rod, and the limit sleeve is slidably connected in the accommodation cavity.

11. The central locking apparatus for the folding tent according to claim 1, wherein the wrench assembly is rotatably connected to the bottom plate by using a pin shaft, and a reset torsion spring is sleeved on the pin shaft.

12. A central locking apparatus for a folding tent, the central locking apparatus comprising a top plate, a bottom plate assembly, and a center rod disposed between the top plate and the bottom plate assembly, wherein the bottom plate assembly comprises a bottom plate, a wrench, and a second upper sliding block, the wrench is rotatably connected to the bottom plate, the second upper sliding block is slidably connected in the bottom plate, a second elastic element is fittingly disposed between one side of the second upper sliding block and the bottom plate, a clamping tongue is disposed on another side of the second upper sliding block, the wrench is capable of driving the second upper sliding block to slide, a bayonet is disposed at a lower end of the center rod, the lower end of the center rod is inserted into the bottom plate, and the clamping tongue is inserted into the bayonet, wherein a second lower sliding block is disposed between the wrench and the second upper sliding block, the second lower sliding block is capable of sliding up and down in the bottom plate, the second lower sliding block abuts on the second upper sliding block, and when the second lower sliding block slides upwards, the second lower sliding block is capable of pushing the second upper sliding block to slide to the second elastic element.

13. The central locking apparatus for the folding tent according to claim 12, wherein a lower end of the second upper sliding block has a second lower slope surface, a back of the second lower slope surface tilts towards one side of the clamping tongue, an upper end of the second lower sliding block has a second upper slope surface whose shape matches a shape of the second lower slope surface, and the second upper slope surface abuts on the second lower slope surface.

14. The central locking apparatus for the folding tent according to claim 12, wherein one end of the wrench, abutting on the second lower sliding block, is set as a cam.

15. The central locking apparatus for the folding tent according to claim 12, wherein the bottom plate comprises a bottom plate upper portion and a bottom plate lower portion that are fixedly connected, an accommodation cavity is disposed between the bottom plate upper portion and the bottom plate lower portion, the bottom plate upper portion has a jack that communicates with the accommodation cavity, the jack is used to connect the center rod, and the second upper sliding block is slidably connected in the accommodation cavity.

16. The central locking apparatus for the folding tent according to claim 12, wherein the second elastic element is a second reset spring.

17. The central locking apparatus for the folding tent according to claim 12, wherein the wrench is rotatably connected to the bottom plate by using a pin shaft, and a reset torsion spring is sleeved on the pin shaft.

18. The central locking apparatus for the folding tent according to claim 12, wherein the center rod comprises a telescopic rod and a sleeve tube sleeved outside the telescopic rod, an upper end of the telescopic rod and an upper end of the sleeve tube are both fittingly connected to the top plate, the bayonet is disposed at a lower end of the telescopic rod, a lower end of the sleeve tube has a socket corresponding to the bayonet, and when the telescopic rod telescopes, the sleeve tube is inserted into the bottom plate and the limit sleeve, and the clamping tongue is inserted into the socket and the bayonet.

* * * * *